United States Patent [19]

Eggenberger et al.

[11] 4,253,308

[45] Mar. 3, 1981

[54] TURBINE CONTROL SYSTEM FOR SLIDING OR CONSTANT PRESSURE BOILERS

[75] Inventors: Markus A. Eggenberger; Patrick C. Callan, both of Schenectady, N.Y.

[73] Assignee: General Electric Company, Schenectady, N.Y.

[21] Appl. No.: 46,865

[22] Filed: Jun. 8, 1979

[51] Int. Cl.[3] ..... F01K 13/00

[52] U.S. Cl. ..... 60/664; 60/663; 60/680

[58] Field of Search ..... 60/646, 652, 657, 660, 60/662, 663, 677, 679, 680, 664

[56] References Cited

U.S. PATENT DOCUMENTS

| | | | |
|---|---|---|---|
| 3,097,488 | 7/1963 | Eggenberger et al. | 60/660 X |
| 3,488,961 | 1/1970 | Gerber | 60/662 X |
| 3,699,681 | 10/1972 | Frutschi | 60/682 |
| 3,919,846 | 11/1975 | Lecocq | 60/657 |
| 3,928,972 | 12/1975 | Osborne | 60/646 |
| 4,118,935 | 10/1978 | Andersson | 60/662 |
| 4,132,076 | 1/1979 | Weiss | 60/646 |

OTHER PUBLICATIONS

*Proceedings of the American Power Conference,* vol. 35, pp. 365–376, "Bypass Stations for Better Coordination Between Steam Turbine and Steam Generator Operation", P. Martin and L. Holly.

*Primary Examiner*—Allen M. Ostrager
*Assistant Examiner*—Stephen F. Husar
*Attorney, Agent, or Firm*—Ormand R. Austin; John F. Ahern

[57] ABSTRACT

An automatic control system enabling comprehensive operation of a reheat steam turbine with sliding or constant pressure boilers. The control system includes an HP control valve for regulating steam flow to the high-pressure turbine according to load and speed demands, an intercept valve for regulating steam flow to the low-pressure turbine and for reheater pressure control, and a bypass flow system for bypassing excess boiler steam during periods of low loading. The bypass system includes a high-pressure bypass sub-system and a low-pressure bypass sub-system, each having a flow control valve and provision for desuperheating the steam. A signal indicative of actual load demand (ALD) and proportional to the product of boiler pressure and main control valve flow demand is produced. From the ALD signal, reference functions are generated to effect control of the bypass valves. The intercept valve is controlled directly by the ALD signal with a regulation factor inversely proportional to the minimum allowable reheat pressure. Coordinated valve control is effected during all principal phases of turbine operation.

12 Claims, 5 Drawing Figures

TURBINE CONTROL SYSTEM FOR SLIDING OR CONSTANT PRESSURE BOILERS

This invention pertains to control systems for steam turbines and more particularly to a control system enabling comprehensive operation of a reheat steam turbine with constant or sliding pressure boilers.

BACKGROUND OF THE INVENTION

Certain advantages may be realized by operating the steam turbines of electrical power generating stations with constant or sliding pressure boilers. This mode of operation permits the steam boiler to be maintained at a high steam production rate independently of the load demand on the steam driven turbine and is attained by using a bypass arrangement to divert the excess steam around the turbine directly to the condenser during periods of low turbine loading. As load on the turbine is increased, more steam flow can be apportioned to it and less bypassed until a point is reached at which all of the steam is devoted to the turbine and none bypassed. Once the bypass is completely shut off the boiler pressure may be allowed to increase, or slide upward, to its rated pressure in support of the turbine demand for steam. Conversely, with a lessening of turbine load, the boiler pressure may be allowed to slide down to some acceptable minimum level, followed, if necessary, by again bypassing the excess steam. Among the principal advantages of this kind of operation are (1) shorter turbine startup times; (2) use of larger turbines for cycling duty where there must be a quick response to changes in load; and (3) avoidance of boiler trip-out with sudden loss of load. A general discussion of the sliding pressure mode of operation appears in Vol. 35, *Proceedings of the American Power Conference,* "Bypass Stations for Better Coordination Between Steam Turbine and Steam Generator Operation", by Peter Martin and Ludwig Holly.

Contrasted with the more conventional mode of turbine operation (wherein the boiler generates only enough steam for immediate use and where there are no bypass valves), the sliding pressure mode necessitates unified control of a more complex valving arrangement. The control system must provide precise coordination of the various valves in the steam flow paths and do so under all operating conditions while maintaining appropriate load and speed control. There are three principal phases to consider in the operation.

1. With the turbine down and the boiler at reduced pressure, or being started up, steam must be bypassed from the main steam line to the cold reheat line, and from the hot reheat line to the condenser by means of pressure-controlled bypass valves;

2. Upon turbine startup, the control and intercept valves should open according to a relationship that maintains reheat pressure at a predetermined level regardless of main steam pressure and in coordination with the bypass valves for unified control of the boiler and reheater pressures; and, 3. At a predetermined turbine load the bypass valves should become fully closed, the control valves held in approximately constant position, and the boiler pressure ramped up to rated pressure by increasing steam flow.

Various control systems have been developed for reheat steam turbines operating in a sliding pressure regime. In one known scheme, pressure in the first stage of the turbine is used as an indicator signal of steam flow from which reference setpoints are generated for control of the high-pressure and low-pressure bypass valves. There are no provisions, however, for directly coordinating the bypass valves with operation of the main control valve, which must be responsive to speed and load requirements, nor for coordination with other valves of the system. Furthermore, it is recognized that first stage pressure is not a valid indicator of steam flow under all prevailing conditions.

In another known sliding pressure control system, a flow measuring orifice in the main steam line provides a signal indicative of total steam flow, forming the basis for a pressure reference signal for control of the high-pressure and low-pressure bypass valves. The flow measurement thus made requires an intrusion into the steam flow path, a corresponding pressure drop, and additional equipment not normally available.

The fundamental signals upon which these and other prior art systems depend for control are derived from sources other than the controller responsible for maintaining turbine speed and load. Thus, in these previous systems there has been a group of somewhat independent control loops; one for speed and load, others for the bypass valves. An object of the present invention, therefore, is to provide a comprehensive control system for turbines in the sliding or constant pressure mode of operation wherein the speed and load control means is incorporated into a unified system for control of all valves, and wherein operation is coordinated with control of boiler and reheat pressures by automatically positioning the main control valve, the intercept valve, and the high- and low-pressure bypass valves.

Another object of the invention is to provide an improved and unified control system for reheat steam turbines operable in conjunction with sliding or constant pressure boilers and wherein automatic control is effective during all phases of turbine operation.

SUMMARY OF THE INVENTION

The invention provides an improved control system for a reheat steam turbine operating from sliding or constant pressure boilers by producing an actual load demand (ALD) signal from which two independent pressure reference functions are generated. Serving as setpoint values, the pressure references are compared with actual boiler and reheat pressure to regulate the high-pressure (HP) bypass and low-pressure (LP) bypass valves accordingly. The ALD signal, with a gain inversely proportional to the minimum allowable reheat pressure, is applied directly to position the intercept valve. The main control valve is positioned by speed and load signals as is disclosed in U.S. Pat. No. 3,097,488 to M. A. Eggenberger et al, which disclosure is incorporated herein by reference thereto. The ALD signal is the yield of a multiplier element, and is the product of boiler pressure and the HP control valve positioning signal which is derived from the speed and load control loop. Valid under all operating conditions as an indication of actual load demand, a continuous readout of the ALD signal is provided.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
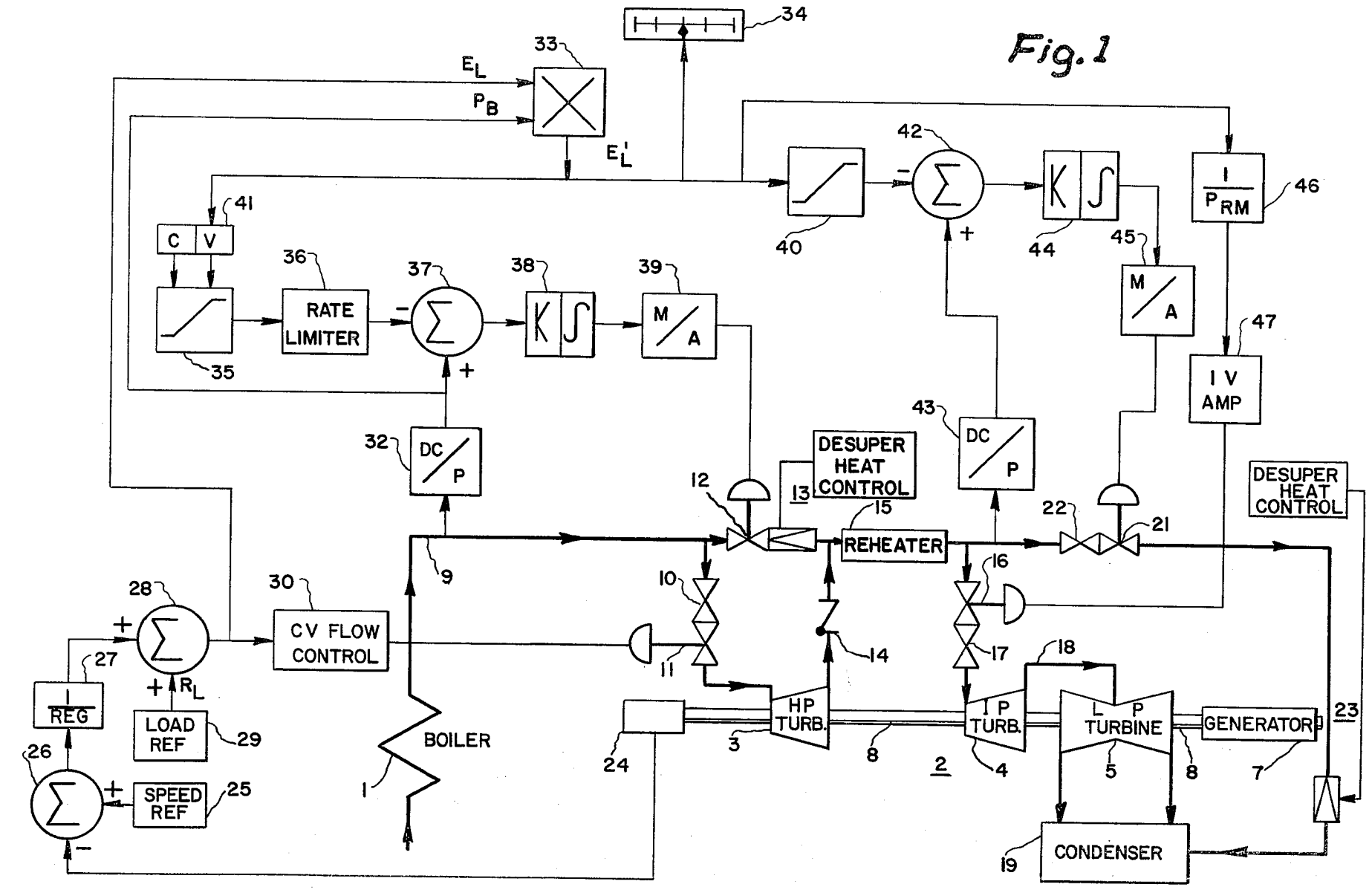
FIG. 1 schematically illustrates, in block diagram format, a preferred embodiment of the turbine control system according to the present invention.

In the electrical power generating plant shown in FIG. 1 a boiler 1 serves as the source of high-pressure steam, providing the motive fluid to drive a reheat steam turbine generally designated as 2 and including high-pressure (HP) turbine 3, intermediate-pressure (IP) turbine 4, and low-pressure (LP) turbine 5. The turbine sections 3, 4, and 5 are coupled in tandem and to electrical generator 7 by a shaft 8.

The steam flow path from boiler 1 is through conduit 9, from which steam may be taken to HP turbine 3 through main stop valve 10 and HP control valve 11. A high-pressure bypass sub-system including HP bypass valve 12 and desuperheating station 13 provides an alternative or supplemental steam path around HP turbine 3. Steam flow exhausting from HP turbine 3 passes through check valve 14 to rejoin any bypassed steam, and the total passes through reheater 15. From reheater 15, steam may be taken through the intercept valve 16 and reheat stop valve 17 to the IP turbine 4 and LP turbine 5 which are series connected by conduit 18. Steam exhausted from the LP turbine 5 flows to the condenser 19. A low-pressure bypass sub-system including LP bypass valve 21, LP bypass stop valve 22, and desuperheater 23 provides an alternative or supplemental steam path around IP turbine 4 and LP turbine 5 to condenser 19.

Rotational speed and output power of the turbine 2 are related to the admission of steam by control valve 11 which, although referred to herein as a single valve for the purpose of explaining the invention, is actually a plurality of valves circumferentially arranged about the inlet to the high-pressure turbine to achieve full or partial arc admission of steam as desired. A speed and load control loop, operative to position control valve 11, includes speed transducer 24 providing a signal indicative of actual turbine speed, a speed reference unit 25 by which the desired speed may be selected, and a first summing device 26 which compares the actual speed with the desired speed and supplies a speed error signal proportional to the difference. The error signal from summing device 26 is amplified by gain element 27 to provide one input to second summing device 28 wherein the amplified error signal is compared with a load reference $R_L$ supplied by load reference unit 29. Under steady-state conditions, the speed error signal is zero so that the output of second summing device 28 is a signal representative of the load setting. This signal, referred to as $E_L$, is applied to CV control unit 30. Control unit 30 may include a power amplification device to operate control valve 11 in accord with $E_L$, and may also include means to linearize the flow characteristics of the control valve 11. The speed and load control branch of the system is substantially the same as was disclosed in the aforementioned patent, U.S. Pat. No. 3,097,488 to Eggenberger et al.

Control of the HP bypass valve 12, the low-pressure bypass valve 21, and the intercept valve 16 is determined by a signal indicative of turbine actual load demand (ALD) and designated as $E_L'$. $E_L'$ is formed by taking the product of $E_L$ (the output of the second summing device 28) and $P_B$ (the boiler pressure as measured by pressure transducer 32) in multiplier 33. The ALD signal $E_L'$ is applied to a load demand readout 34 in addition to control loops for regulating the HP bypass valve 12, the LP bypass valve 21, and the intercept valve 16 as mentioned above. The HP bypass control loop includes $P_{REF\ HP}$ function generator 35, mode selector 41, rate limiter 36, third summing device 37, boiler pressure transducer 32, proportional plus integral controller 38, manual/automatic selector 39, and HP bypass valve 12; the LP bypass control loop includes $P_{REF\ LP}$ function generator 40, fourth summing device 42, reheater pressure transducer 43, proportional plus integral controller 44, manual/automatic selector 45, and LP bypass valve 21; and the intercept valve control loop includes adjustable gain amplifier 46, intercept valve 16, and IV control unit 47 which may include means to linearize the flow characteristics of valve 16.

Figure 2:
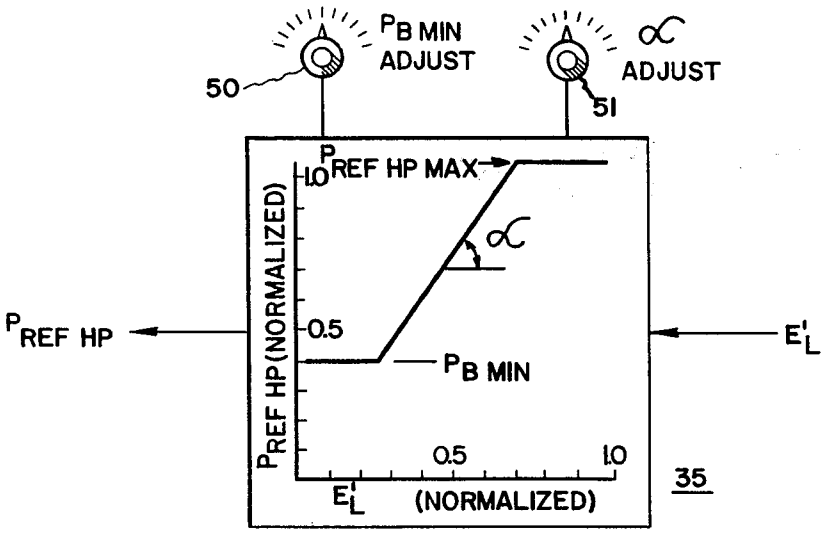
FIG. 2 is an example of the high-pressure reference signal ($P_{REF\ HP}$), generated as a function of the actual load demand signal.

In the HP bypass control loop, $P_{REF\ HP}$ function generator 35 provides a reference signal, or setpoint, against which the boiler pressure $P_B$ as measured by transducer 32 is compared in third summing device 37. The HP bypass valve 12 is positioned in accord with the output signal from summing device 37, being caused to open more or less as $P_B$ is greater or lesser than $P_{REF\ HP}$, the signal from function generator 35. An example of the function produced by $P_{REF\ HP}$ function generator 35 is shown in FIG. 2 wherein $P_{REF\ HP}$ is a function of $E_L'$. In the example shown, $P_{REF\ HP}$ at low values of $E_L'$ is a constant equal to a minimum selected boiler pressure $P_{B\ MIN}$, then is ramped upward to a second constant value $P_{REF\ HP\ MAX}$, selected to be just greater than the rated boiler pressure, with higher values of $E_L'$. Function generator 35 includes adjustments 50 and 51 provided, respectively, to select $P_{B\ MIN}$ and the value of $\alpha$, the slope of the ramped portion of the function $P_{REF\ HP}$. In terms of valve operation, the HP bypass valve 12 is throttling at the lower values of $E_L'$ to maintain $P_{B\ MIN}$, then is fully closed as the function $P_{REF\ HP}$ is ramped up. Function generators operative as described, and as will hereinafter be described in conjunction with the LP bypass control loop, are well known in the art and may generally be of the type described in U.S. Pat. No. 3,097,488.

Rate limiter 36 prevents $P_{REF\ HP}$ from declining at an excessive rate with a sudden drop of $E_L'$ as may occur with a sudden loss of load. This prevents the occurrence of a large error signal which would tend to rapidly swing the bypass valve 12 from closed to opened, causing shock to the boiler 1 from the quick release of steam pressure. Proportional plus integral controller 38 accepts the error signal from third summing device 37 to produce a signal proportional to the error and its time integral so as to position HP bypass valve 12 accordingly. The manual/automatic selector 39 provides for disengaging the HP bypass valve 12 from automatic control so that it can be manually positioned, and allows control to be readily switched from automatic to manual and vice versa. Mode selector 41 allows control according to the $P_{REF\,HP}$ function (sliding pressure) or, by substituting a constant value for $P_{REF\,HP}$, at a constant pressure.

Figure 3:
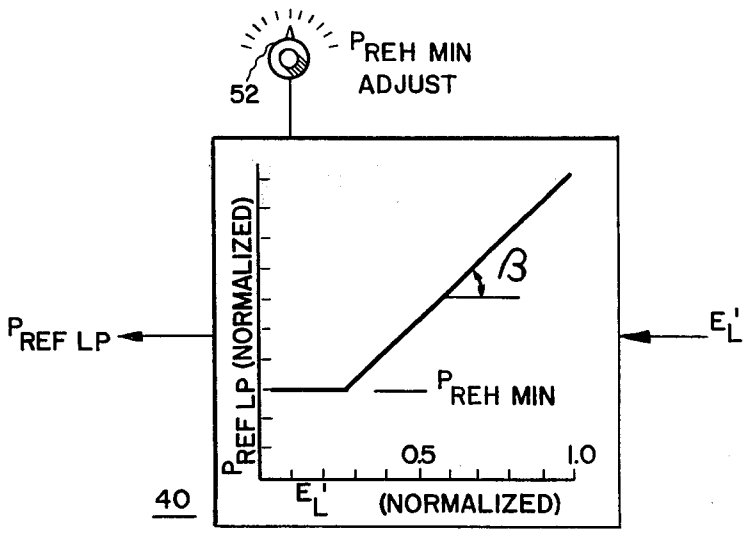
FIG. 3 is an example of the low-pressure reference signal ($P_{REF\ LP}$), generated as a function of the actual load demand signal.

In the LP bypass control loop, $P_{REF\,LP}$ function generator 40 provides a reference pressure signal or setpoint based on the value of $E_L'$, for example, as shown in FIG. 3. The function $P_{REF\,LP}$ is a constant at lower values of $E_L'$, representing the minimum allowable reheat pressure $P_{REH\,MIN}$, then is ramped upward with slope $\beta$ as $E_L'$ increases. The $P_{REF\,LP}$ function generator 40 is provided with adjustment 52 to select the desired valve of $P_{REH\,MIN}$, which is determined by the operating specifications of the reheater boiler 15. The $P_{REF\,LP}$ value is compared with actual reheater pressure, as measured by transducer 43, in fourth summing device 42 and the error signal therefrom applied to proportional plus integral controller 44 which automatically directs operation of LP bypass valve 21 to minimize the error signal. Manual/automatic selector 45 allows the LP bypass valve 21 to be operated manually or automatically as was described above for the HP bypass valve 12.

Figure 5:
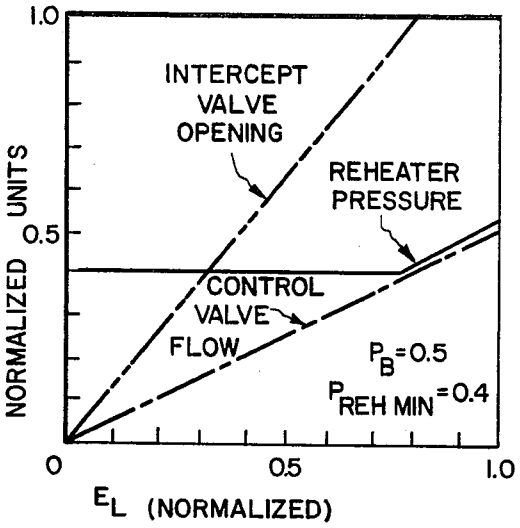
FIG. 5 is a graphic illustration similar to FIG. 4 showing the coordination of control between the intercept valve and the HP control valve to maintain minimum reheater pressure at lower load and, taken with FIG. 4, illustrates that valve coordination is independent of boiler pressure.
Figure 4:
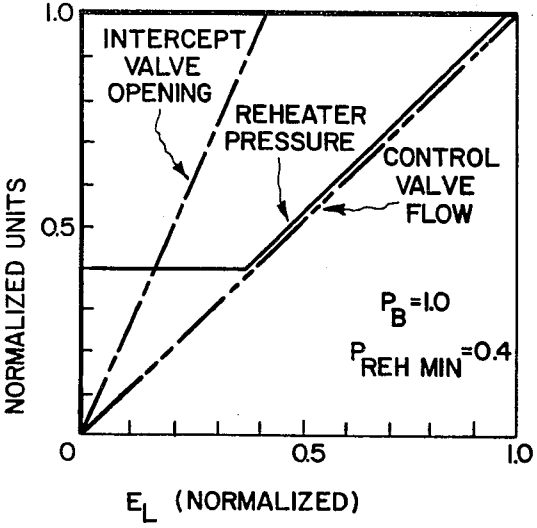
FIG. 4 graphically illustrates the relationship between HP control valve steam flow, reheater pressure, and position of the intercept valve with changes in load, all as functions of the turbine load signal and at constant boiler pressure.

The intercept control loop provides for throttling the intercept valve at reduced load to maintain the minimum allowable reheater pressure $P_{REH\,MIN}$. This is achieved by passing the $E_L'$ signal through amplifier 46 whose gain is selected to be inversely proportional to $P_{REH\,MIN}$. The output from amplifier 46 is applied to IV control unit 47 providing a proportional power signal for operating intercept valve 16. The coordinated operation of control valve 11 with intercept valve 16 is illustrated graphically in FIGS. 4 and 5, each figure showing the results with a different boiler pressure $P_B$. The plots of FIGS. 4 and 5 are in normalized units covering a range of 0 to 1.0 representing generally, 0 to 100% of the possible span of a particular variable. For example, a boiler pressure $P_B$ stated to be 0.5 units may be taken as a boiler pressure of 50% of rated pressure. Thus in referring to the plot of intercept valve opening as shown in FIGS. 4 and 5, a normalized value of 1.0 indicates the valve is fully open, a value of 0.5 that the valve is one-half open, and so on. This permits description of the control system independent of the limiting parameters of any given system component, e.g., boiler capacity or pressure. The graphs show that the intercept valve throttles over the range of $E_L$ necessary to maintain the minimum reheater pressure in accord with $E_L'$ and the steam flow through the control valve 11, but independently of the main boiler pressure.

OPERATION

Operation of the invention can best be explained in terms of numerical values assigned to the various operating parameters to serve as illustrative examples. For that purpose, and for signal manipulation, the parameters can be expressed in terms of normalized units as was explained above. For the following description of different phases of turbine operation, reference is made to FIGS. 1–5.

Just prior to startup of the turbine, the boiler 1 is operated at some minimum steam flow and pressure. There may, for example, be 0.3 units of flow at 0.4 units of pressure with all of the steam being bypassed through the bypass system around turbine 2 to the condenser 19. The turbine 2 is then started by appropriately setting speed reference unit 25 and load reference unit 29 to cause steam flow through the control valve 11 and the intercept valve 16. For example, when the load reference signal $R_L$ is increased to 0.3 units, assuming no speed error, $E_L$ also equals 0.3 and flow to the high-pressure turbine 3 is 0.12 units ($0.3E_L \times 0.4P_B = 0.12E_L'$). The actual load demand (ALD) readout 34 will, at this point, display 0.12 units of demand, numerically equal to the steam flow into the high-pressure turbine 3. Furthermore, if the minimum allowable reheat pressure setting $P_{REH\,MIN}$ is 0.3 units, then flow through the intercept valve 16, intermediate pressure turbine 4, and low-pressure turbine 5 will also be 0.12 units ($0.3P_{REH} \times 0.12E_L'/0.3P_{REH\,MIN}$). The latter parenthetical expression results from multiplying the reheater pressure by the ALD signal and multiplying that product by the gain ($1/P_{REH\,MIN}$) of intercept loop amplifier 46.

If, at this point, $R_L$ is increased to 0.7, the ALD signal will move to 0.28 and, from the graphs of FIGS. 2 and 3 as examples, the HP and LP bypass valves 12 and 21 will become very nearly closed with $P_{REF\,HP}$ and $P_{REF\,LP}$ on the verge of being ramped up. Flow through the intercept valve 16 will be 0.28 units ($0.3P_{REH} \times 0.28E_L'/0.3P_{REH\,MIN}$) and the valve 16 will be very nearly wide open ($0.28E_L'/0.3P_{REH\,MIN} \simeq 1.0$ units, where a value of 1.0 in the intercept control loop results in intercept valve 16 being fully open). Since the gain of the intercept loop is matched to the inverse of $P_{REH\,MIN}$, coordination of the control valve 11 and intercept valve 16 is assured as illustrated by the graphs of FIGS. 4 and 5.

At higher loads the $R_L$ signal can be fixed, or held constant, and if conditions are steady-state with respect to speed, $R_L$ will equal $E_L$. Thus the control valve 11 will be fixed in position and the boiler pressure may be allowed to slide upward to satisfy increasing load demands on the turbine 2. The ALD readout 34 will display the actual load demand under all conditions, showing an increasing value as boiler pressure slides upward. Above 0.7 units of actual load, as illustrated in the examples of FIGS. 2 and 3, the boiler will be at full pressure and control of the turbine 2 will be as is conventional for a turbine not having a bypass valving arrangement.

As load is reduced, mode selector 41 may be brought into play, permitting the boiler 1 to be operated at a constant elevated pressure. In this constant pressure mode, mode selector 41 negates the effect of a changing value of $E_L'$ on the output of function generator 35 by substituting a constant value for $P_{REF\,HP}$. At constant pressure, intercept valve 16 operates in coordination with control valve 11 as load is reduced; the HP bypass valve 12 controls the pressure of the boiler 1 at a selected constant value of $P_{REF\,HP}$, and the LP bypass valve, with the intercept valve, controls reheater pressure.

If turbine load is reduced while in the variable pressure mode, and unless there is very sudden loss of load, operation of the system is the reverse of that obtained during the loading process, and the boiler and reheater pressures are allowed to slide down to the minimum preselected values. With a sudden loss of load, rate limiter 36 prevents a precipitous drop in the signal applied to third summing device 37, avoiding a rapid opening of the HP bypass valve 12 and causing a sudden blowdown of the pressure of boiler 1.

While there has been shown and described what is considered to be a preferred embodiment of the invention, and there has been set forth the best mode contemplated for carrying it out, it will be understood that various modifications may be made therein. It is intended to claim all such modifications which fall within the true spirit and scope of the present invention.

What is claimed is:

1. A comprehensive control system for a steam turbine operating in conjunction with a boiler generating steam pressure, the turbine having a high-pressure (HP) section, at least one lower pressure (LP) section, a steam conduit interconnecting the HP section to the LP section through a steam reheater, at least one admission control valve for regulating the flow of steam to the HP section, and an intercept valve for regulating the flow of steam to the LP section, comprising:

an HP bypass sub-system for passing steam around said high-pressure section, said bypass sub-system including an HP bypass valve for regulating steam flow;

an LP bypass sub-system for passing steam around said lower pressure section, said bypass sub-system including an LP bypass valve for regulating steam flow;

a load and speed control loop for operating said admission control valve to maintain preset turbine speed and load, said control loop having an admission control valve position signal;

a multiplying means for providing an actual load demand (ALD) signal representing the product of boiler steam pressure and the admission control valve position signal;

an HP bypass control loop for operating said HP bypass valve to control boiler steam pressure in accord with a first reference signal determined from said ALD signal;

an LP bypass control loop for operating said LP bypass valve to control reheater steam pressure in accord with a second reference signal determined from said ALD signal; and, an intercept control loop for operating said intercept valve in response to said ALD signal.

2. The control system of claim 1 wherein said intercept control loop includes means for providing an intercept valve signal proportional to the product of said ALD signal and the inverse of a preselected value of reheater pressure for controlling the position of said intercept valve.

3. The control system of claim 1 or claim 2 wherein:

said HP bypass control loop includes an HP function generator for providing said first reference signal as a preselected function of said ALD signal, a transducer providing a boiler steam pressure signal, means for comparing said first reference signal with said boiler pressure signal to produce an HP error signal for controlling the positioning of said HP bypass valve to maintain equilibrium between said first reference signal and said boiler pressure signal;

said LP bypass control loop includes an LP function generator for providing said second reference signal as a preselected function of said ALD signal, a transducer providing a reheater steam pressure signal, means for comparing said second reference signal with said reheater pressure signal to produce an LP error signal for controlling the positioning of said LP bypass valve to maintain equilibrium between said second reference signal and said reheater pressure signal.

4. The control system of claim 3 wherein:

said HP function generator is adapted to provide said first reference signal at a first constant value for lower values of said ALD signal and to linearly increase said reference signal at slope $\alpha$ to a second constant value at higher values of said ALD signal, said HP function generator having means for selecting said first constant value and means for selecting said slope $\alpha$; and said LP function generator is adapted to provide said second reference signal at a third constant value for lower values of said ALD signal and to linearly increase said reference signal at slope $\alpha$ at higher values of said ALD signal, said LP function generator having means to select said third constant value.

5. The control system of claim 4 wherein said HP bypass control loop includes means for limiting the time rate of change of said first reference signal so that the opening rate of said HP bypass valve is limited.

6. The control system of claim 5 further including means for displaying the magnitude of said ALD signal.

7. The control system of claim 6 wherein said HP bypass control loop includes means to selectively transfer between a sliding pressure control mode and a constant pressure control mode, said transfer means having means for disengaging said first reference signal and substituting therefor a selectable constant valued signal.

8. The control system of claim 7 wherein:

said HP bypass control loop includes an HP manual/automatic selector, said selector effective to transfer said HP bypass valve between an automatic mode of operation wherein said valve is operated in response to said HP error signal and a manual mode of operation wherein said valve is operated in response to a first manual operating means; and, said LP bypass control loop includes an LP manual/automatic selector, said selector effective to transfer said LP bypass valve between an automatic mode of operation wherein said valve is operated in response to said LP error signal and a manual mode of operation wherein said valve is operated in response to a second manual operating means.

9. The control system of claim 8 wherein:

said HP bypass control loop includes means for producing an HP bypass valve position signal according to the sum of said HP error signal and the time integral value of said HP error signal; and, said LP bypass control loop includes means for producing an LP bypass valve position signal according to the sum of said LP error signal and the time integral value of said LP error signal.

10. A reheat steam turbine for operation with a sliding or constant pressure boiler, comprising:

a high-pressure (HP) turbine section, at least one lower-pressure (LP) turbine section, steam conduit means connecting the HP and LP sections, means reheating the steam between the HP and LP turbine sections, at least one control valve for controlling the flow of steam to the HP section, an intercept valve for controlling the flow of reheated steam to the LP section, an HP bypass for passing steam around the HP turbine section, an HP bypass valve for controlling the flow of steam in the HP bypass, an LP bypass for passing steam around the LP turbine section, an LP bypass valve for controlling the flow of steam in the LP bypass, a control loop for positioning the control valve to maintain preset turbine speed and load and for supplying a control valve position signal, means for supplying a signal representative of boiler steam pressure, means for generating an actual load demand (ALD) signal as the product of the boiler pressure signal and the control valve position signal, an HP bypass control loop having means for generating a first preselected reference signal as a function of the ALD signal and means for positioning the HP bypass valve to maintain equilibrium between the boiler pressure signal and the first preselected reference signal, means supplying a signal representative of reheated steam pressure, an LP bypass control loop having means for generating a second preselected reference signal as a function of the ALD signal and means for positioning the LP bypass valve to maintain equilibrium between the reheated steam pressure signal and the second preselected reference signal, and an intercept valve control loop having means for amplifying the ALD signal by a factor proportional to the inverse of a preselected value of reheated steam pressure to supply an amplified ALD signal and means to position the intercept valve in accord with the amplifier signal.

11. In combination with a reheat steam turbine operating in conjunction with a boiler generating steam pressure, the turbine of the type having a high-pressure (HP) section, at least one lower pressure (LP) section, a steam conduit interconnecting the HP section to the LP section through a steam reheater, at least one admission control valve for regulating the flow of steam to the HP section, and an intercept valve for regulating the flow of steam to the LP section, a comprehensive control system enabling sliding or constant pressure boiler operation comprising:

an HP bypass sub-system for passing steam around said high-pressure section, said bypass sub-system including an HP bypass valve for regulating steam flow;

an LP bypass sub-system for passing steam around said lower pressure section, said bypass sub-system including an LP bypass valve for regulating steam flow;

a load and speed control loop for operating said admission control valve to maintain preset turbine speed and load, said control loop having an admission control valve position signal;

a multiplying means for providing an actual load demand (ALD) signal representing the product of boiler steam pressure and the admission control valve position signal;

an HP bypass control loop for operating said HP bypass valve to control boiler steam pressure in accord with a first reference signal determined from said ALD signal;

an LP bypass control loop for operating said LP bypass valve to control reheater steam pressure in accord with a second reference signal determined from said ALD signal; and, an intercept control loop for generating said intercept valve in response to said ALD signal.

12. The combination of claim 11 wherein said intercept control loop includes means for providing an intercept valve signal proportional to the product of said ALD signal and the inverse of a preselected value of reheater pressure for controlling the position of said intercept valve.

* * * * *